US005263353A

United States Patent [19]

Bakermans et al.

[11] Patent Number: 5,263,353

[45] Date of Patent: Nov. 23, 1993

[54] PUNCH AND DIE APPARATUS FOR PRODUCING FLAT STAMPED CONTACT DEVICES HAVING IMPROVED CONTACT EDGE SURFACES

[75] Inventors: Johannes C. W. Bakermans, Harrisburg; Lawrence R. Holbrook, Jonestown, both of Pa.

[73] Assignee: The Whitaker Corporation, Wilmington, Del.

[21] Appl. No.: 905,960

[22] Filed: Jun. 29, 1992

[51] Int. Cl.[5] ..... B21D 28/14; B21D 28/16

[52] U.S. Cl. ..... 72/334; 72/335; 72/339; 29/874

[58] Field of Search ..... 72/334–337, 72/327, 339, 340, 404; 29/874

[56] References Cited

U.S. PATENT DOCUMENTS

| | | | |
|---|---|---|---|
| 2,843,927 | 7/1958 | Stock | 72/335 |
| 3,327,372 | 6/1967 | Berg | 72/339 |
| 4,184,242 | 1/1980 | Petrie | 72/340 |
| 4,211,099 | 7/1980 | McGonigal | 72/339 |
| 4,857,019 | 8/1989 | Brubaker | 72/339 |

FOREIGN PATENT DOCUMENTS

| | | | |
|---|---|---|---|
| 28635 | 2/1982 | Japan | 72/334 |
| 2-68838 | 11/1991 | Japan | 72/334 |
| 1367639 | 9/1974 | United Kingdom | 72/327 |

*Primary Examiner*—Daniel C. Crane
*Attorney, Agent, or Firm*—William B. Noll

[57] ABSTRACT

Flat stamped electrical contact device (2) has a contact edge (8,8') which extends from the first major surface (4) to the second major surface (6) of the device. The contact edge surface (8,8') is smooth for substantially its full width and does not have a fractured portion or a burr extending from the second major surface (6). The smooth straight surface is produced by steps of coining the opening produced during the initial punching operation at a location adjacent to the second major surface after the opening has been punched and then shaving the edge to produce the finished contact surface.

6 Claims, 9 Drawing Sheets

PUNCH AND DIE APPARATUS FOR PRODUCING FLAT STAMPED CONTACT DEVICES HAVING IMPROVED CONTACT EDGE SURFACES

FIELD OF THE INVENTION

This invention relates to flat stamped contact devices and particularly to improvements in the contact edge surfaces of such devices.

BACKGROUND OF THE INVENTION

A wide variety of flat stamped contact devices are now being used in connecting devices for electronic equipment. Flat stamped contact devices have oppositely facing first and second major surfaces and edge surface portions which extend between the major surfaces. The contact areas are on the edge surfaces rather on the flat major surfaces, and the devices are quite thin, for example, 0.014 inches (0.356 mm) or less. The connectors in which flat stamped contact devices are used usually have the contact devices on closely spaced centers, 0.025 inches (0.635 mm) or less. The contact areas on flat stamped contact devices are very narrow and it is important that good electrical contact be established by means of these very narrow contact areas when the devices are put to use.

The nature of the stamping operation is such that the edge surfaces of a stamped part are rough rather than smooth, and do not extend normally of the flat major surfaces. When an opening is produced in strip material, the punch which produces the opening presses a portion of the material into the opening in the die block. Initially, the material is pushed by the force of the punch into the die opening and a relatively smooth burnished surface is produced adjacent to the surface of the strip stock. As the material under the punch is deformed, it work hardens and eventually it fractures producing a rough fractured edge surface. Contact devices are produced by punching a series of openings in strip stock and the contact edge surfaces therefore exhibit this phenomenon of a burnished zone which is relatively flat that extends from one surface of the strip stock partially towards the other. This burnished and flat zone merges with the fractured zone which extends to the other surface of the strip stock. The edge produced does not extend normally of the flat rolled surfaces of the stock but tends to be inclined from the one surface towards the other.

In order to minimize the effects of a conventional punching operation, the tooling can be carefully designed, the material can be selected carefully to produce a minimum fractured zone, and in some cases, the edge can be shaved to provide a smooth surface on the contact edge of the contact device. Shaving does no eliminate all of the problems however for the reason that shaving usually produces a burr extending from one of the surfaces of the contact device and this burr is troublesome when the contact devices are positioned on closely spaced centers.

The present invention is directed to the achievement of flat stamped contact devices having improved contact edge surfaces, and to methods and apparatus for producing improved contact devices.

THE INVENTION

The apparatus for the practice of the present invention comprises a punch and die assembly for manufacturing stamped electrical contacts from strip material which has oppositely facing first and second rolled parallel surfaces. Each of the contacts has an edge surface which extends between the rolled surfaces, the edge surface being the contact surface of the contact device. The punch and die assembly comprises a punch and die station, a coining station, and a final shaving station. The punch and die station comprises a punch and die for punching a hole in the strip stock, one side surface of the hole being the contact surface of the finished contact device. The side surface after punching has a flat smooth portion and a fractured portion, the smooth portion extending inwardly from the first rolled surface to the fractured portion and the fractured portion extending from the smooth portion to the second rolled surface. A coining station is provided having a coining die which coins, and work hardens, a portion of the edge which is adjacent to the second rolled surface. A final shaving station having a final shaving tool is provided which shaves the contact surface along a final shaving path which extends from the first rolled surface to the coin portion so that the final shaving tool produces a smooth shaved surface on the edge which extends from the first rolled surface to the coined portion. The coined portion is fractured in a brittle fracture without plastic deformation so that no burr is produced at the second rolled surface. In the preferred embodiment, a pre-shaving station is provided between the punch and die station and the coining station. The pre-shaving station has a pre-shaving tool which is moved against the second rolled surface and partially across the edge towards the first rolled surface.

The method of the invention comprises the steps of punching the opening in the strip stock which defines the contact edge by movement of a punch towards the first rolled surface of the strip stock and through the stock past the second rolled surface. The opening is punched as undersized so that each contact device is initially oversized in the vicinity of the contact edge relative to the required finished dimensions. The strip is then coined in a zone at the intersection of the edge surface and the second major surface thereby severely to work harden the material in the zone. The final step comprises shaving the edge by moving a final shaving tool across the contact edge from the first major surface to the second major surface. The edge is preferably pre-shaved prior to the coining step by movement of a pre-shaving tool across the contact edge from the second major surface towards the first major surface.

A flat stamped electrical contact device in accordance with the invention has a contact edge surface that has a smooth shaved portion which extends from the first major surface to a location immediately adjacent to the second major surface. The edge surface has a smooth coined portion which extends divergently from the smooth portion to the second major surface at a location adjacent to the second surface.

THE DRAWING FIGURES

Figure 13:
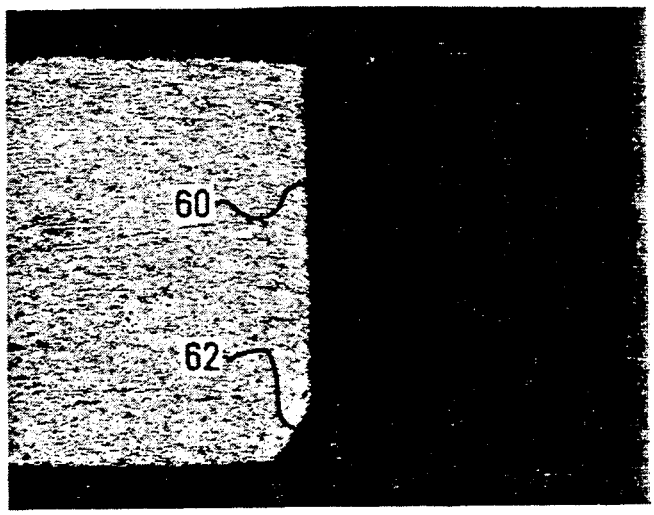
Figure 14:
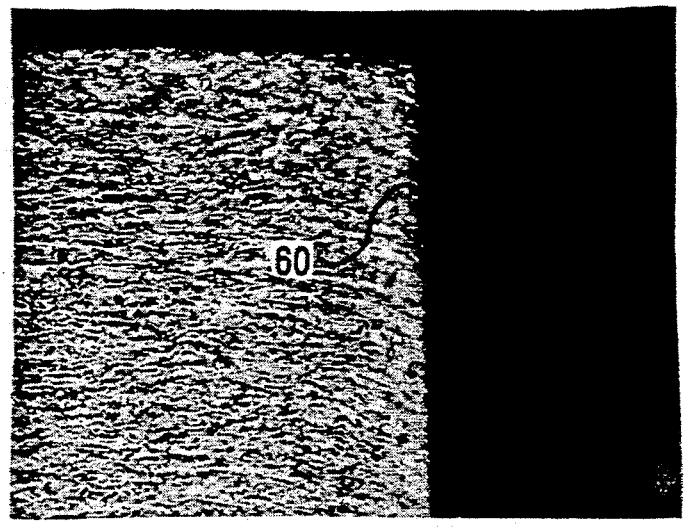
Figure 15:
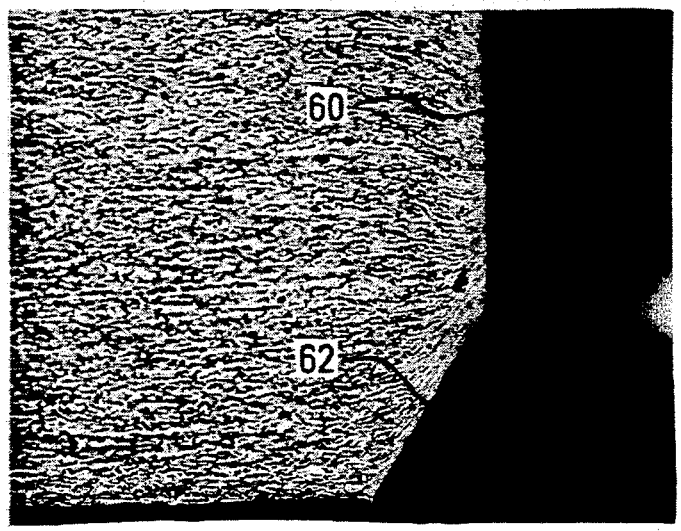

FIGS. 14, and 15 are views on an enlarged scale of the upper portion of the edge and the lower portion of the edge shown in FIG. 13.

Figure 10:
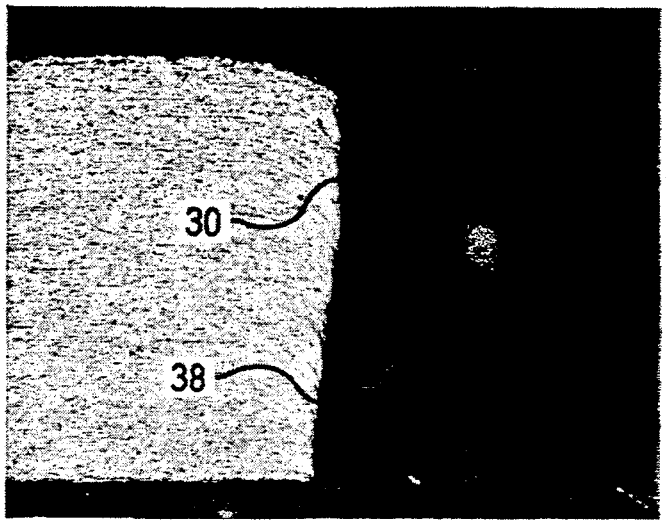
FIG. 10 is a photomicrograph showing the edge produced in strip material by a typical punching operation.
Figure 16:
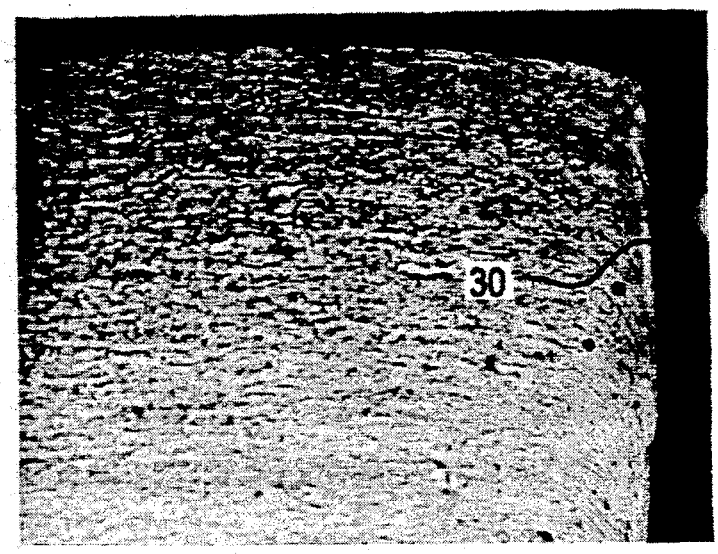
Figure 17:
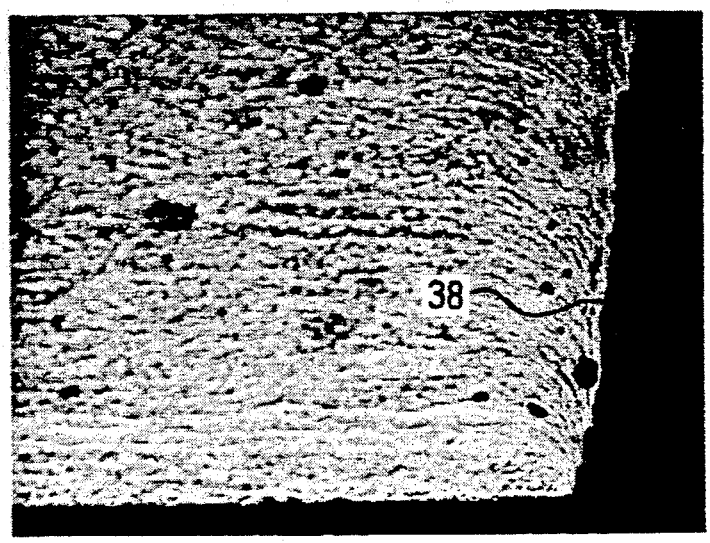

FIGS. 16 and 17 are views similar to FIGS. 14 and 15 of the edge shown in FIG. 10.

Figure 18:
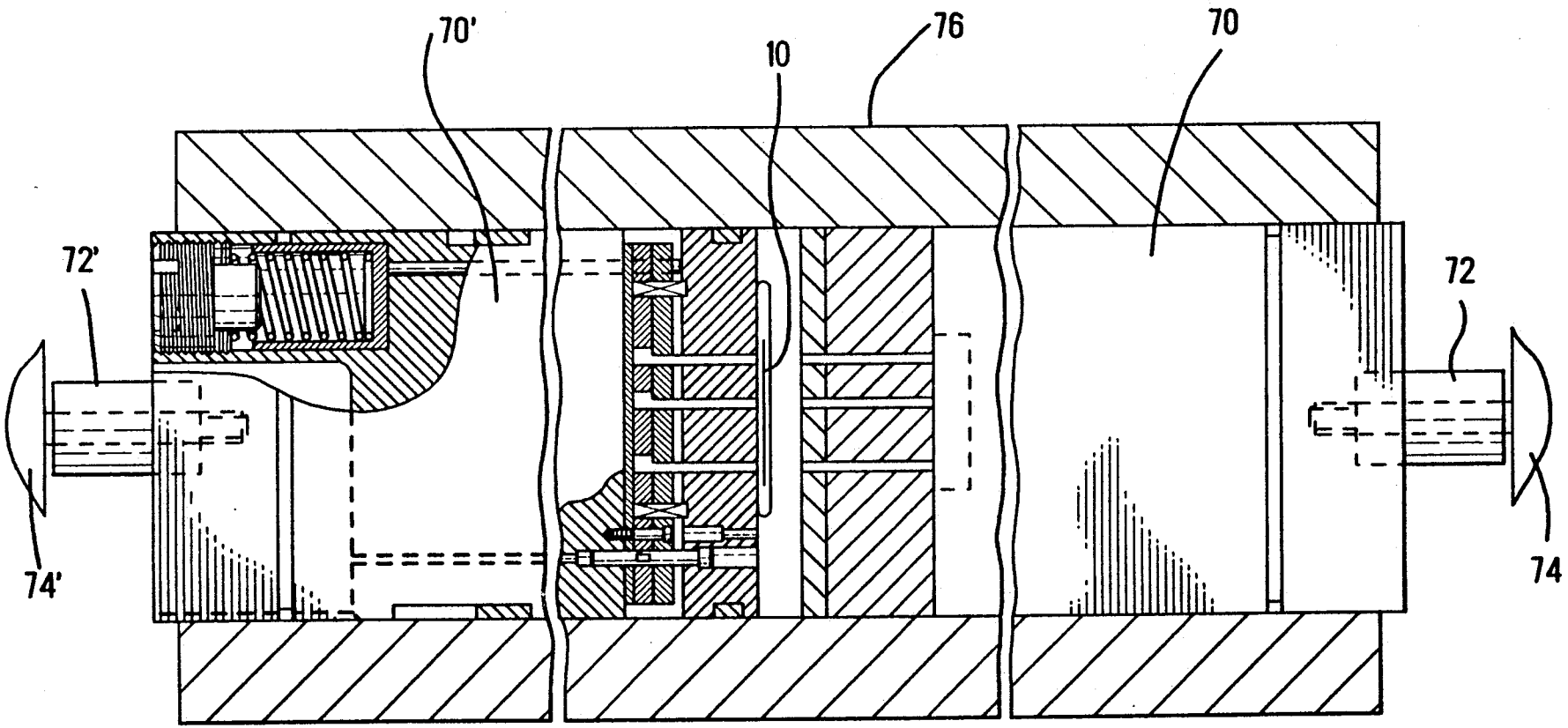

FIG. 18 is a cross sectional view of portions of a stamping machine which is used in the practice of the invention.

THE DISCLOSED EMBODIMENT

Figure 1:
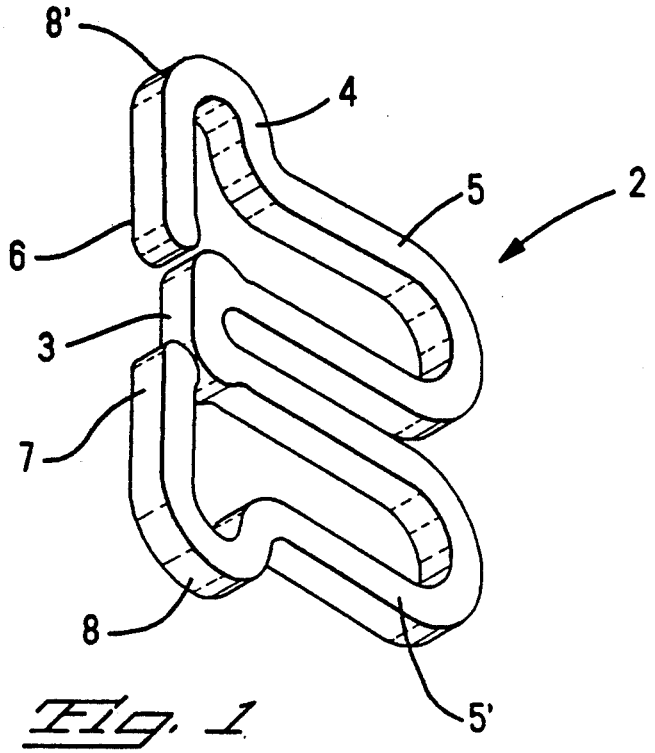
FIG. 1 is a view of a typical flat stamped contact device having contact portions on its edges.
Figure 2:
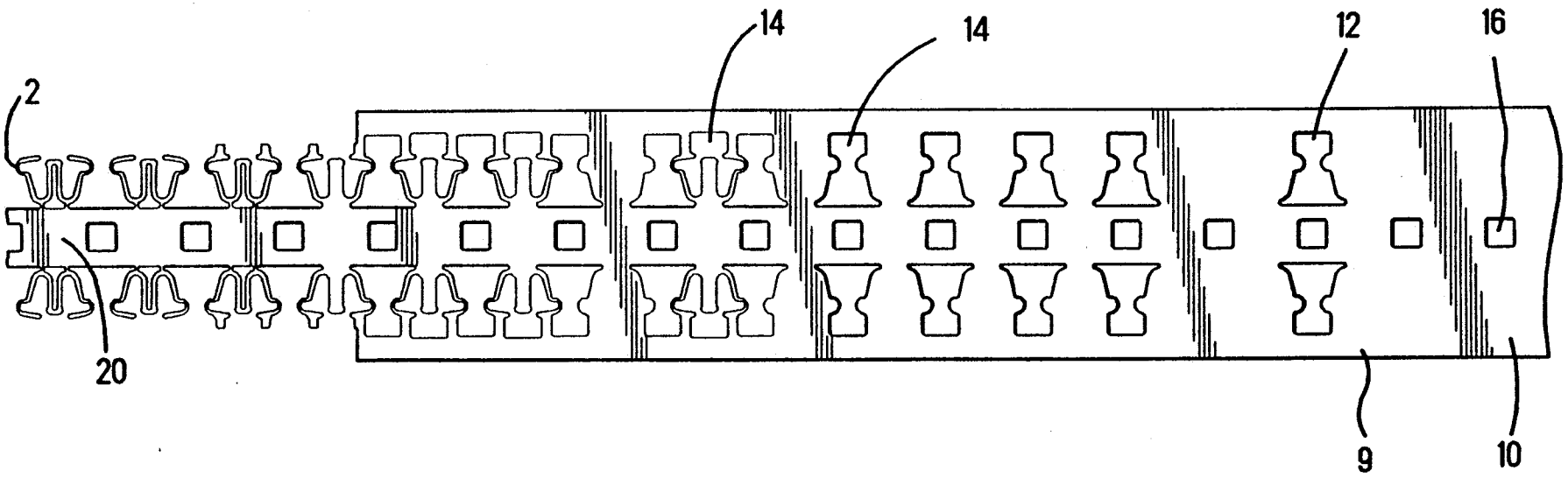
FIG. 2 is a view of a progression of strip material showing the various operations which are carried out to produce contact devices as shown in FIG. 1.

FIG. 1 shows a typical flat stamped contact terminal 2 which was produced by punching openings in strip stock material 10, FIG. 2. The contact terminal 2 has oppositely facing first and second major surfaces 4,6 and side edges 7. The particular contact shown has a generally U-shaped central section 3 and arms 5,5' extending from the central section. The contact portions of the contact device are located at 8 and 8'. Contact devices of the type shown are used to connect terminal pads on substrates which are in parallel spaced apart relationship, as described in U.S. Pat. No. 4,927,369.

Contact devices of the type shown are usually relatively thin, 0.014 (0.356 mm) inches or less and are contained in a housing in spaced apart relationships on centers of about 0.025 inches (0.635 mm). The contact zones 8,8' are therefore extremely narrow and it is important that these contact zones establish good electrical contact with the terminal pads in the substrates when the contacts are placed in service.

Contact terminals 2 of the type shown are produced in continuous strip form from strip stock 10, FIG. 2. The stock material has first and second rolled surfaces 9,11, (FIG. 3) which become the first and second major surfaces 4,6. The contact devices are produced by punching openings 12,14 in the strip as it is fed through a progressive punch and die assembly and the side edges produced by the punching operations become the contact areas 8,8'. The strip shown has a central carrier strip 20 having pilot holes 16 to which contact devices 2 are attached so that they can be removed at a later stage and inserted into a housing.

The present invention is concerned particularly with the punches, dies, and other tooling which produce the contact edge surfaces 8,8' in the finished contact device. The apparatus and method for the invention will now be described with reference to FIGS. 3-9. These Figures do not show actual tooling but are sketches which illustrate the principles of the invention using a simple cylindrical punch 22 and a die block 24 having a die opening 28. The openings in the strip are therefore circular openings however, the principles explained below are used in the actual punches and dies (which would not necessarily be circular or cylindrical) used to produce the contact device 2.

Figure 5:
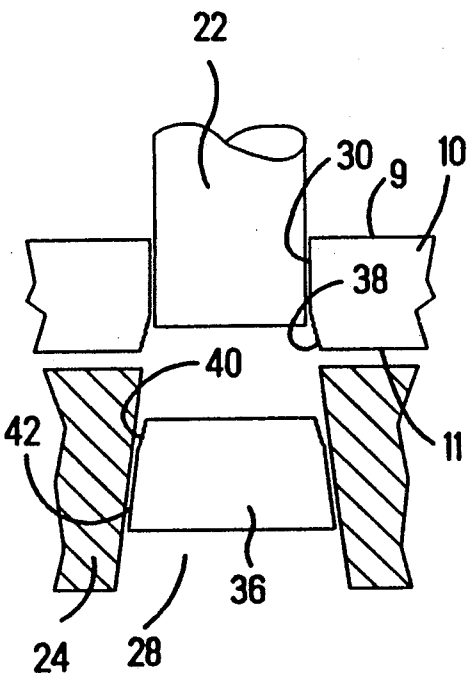
FIGS. 3–5 are a series of sketches which illustrate a typical punching operation in which an opening is punched in strip material.
Figure 4:
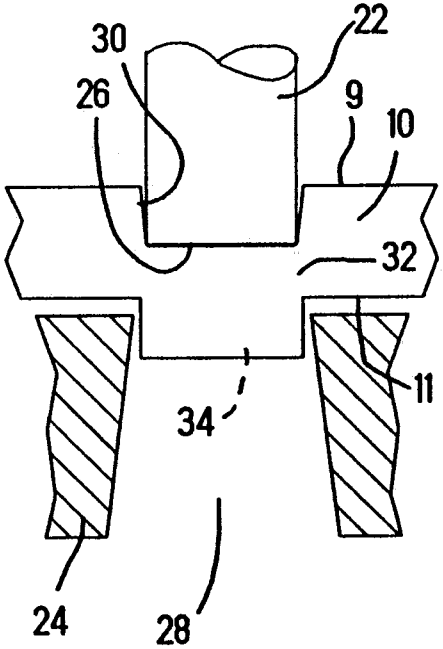

The tooling for producing the contact edges 8,8' is contained in four stations. The first station comprises the previously identified punch 22 and die block 24 having a facial surface 29. The punch has a leading end 26 and the die block has a die opening 28. The stock material 10 is located between the punch and die. As shown in FIGS. 4 and 5, as the punch moves downwardly as viewed in the drawings against the first rolled surface 9 of the stock 10, a slug 34 is pressed from the stock past the second rolled surface 11 and into the die opening 28. During this portion of the stroke of punch 22, the stock material in the zone 32 is severely deformed and work hardened, a phenomenon which is apparent from inspection of the metallic grains which are deformed downwardly as shown in FIGS. 16 and 17. Also, during this initial portion of the punching operation, as the slug 34 is pushed downwardly, a relatively smooth and burnished surface 30 is produced which extends inwardly from the first rolled surface 9.

After the material has work hardened by a certain amount (which may depend upon the initial hardness of the material and other factors) the slug breaks away from the stock material and moves into the die opening as shown at 36. The strip material 10 then has a fractured surface 38 which extends from the burnished surface 30 to the second rolled surface 11. The slug, which is scrap, has a fractured surface 40 and a smooth surface 42.

Figure 6:
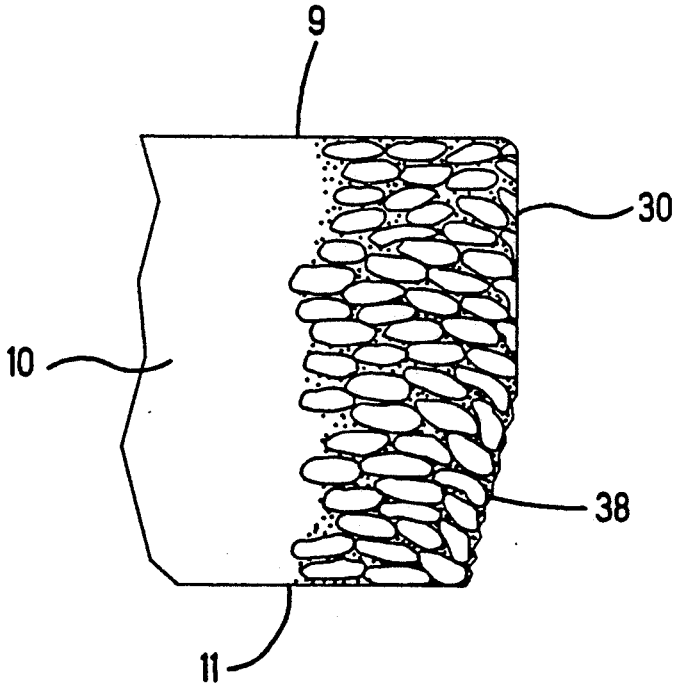
FIG. 6 is a sketch on an enlarged scale showing the edge which is produced when the opening is punched.

FIG. 6 is a drawing which shows features of the microstructure of the material 10 in the vicinity of the opening. The metallic grains adjacent to the edge surface 30,38 are deformed downwardly. The smooth surface is nearly perpendicular, and the fractured surface 38 is divergently inclined away from surface 30. Photomicrographs of this type edge surface are shown in FIGS. 10, 16, and 17. The edge surface 30, 38 is the type of contact edge surface which is found on flat stamped contact terminals which are manufactured by presently known methods.

Figure 7:
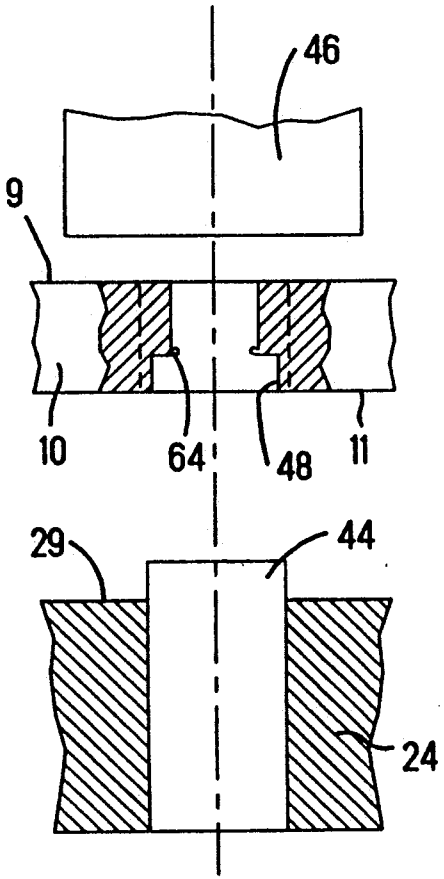

After the opening has been punched in the strip stock, the edge is pre-shaved by a pre-shaving tool 44, FIG. 7 which is mounted in the die block 24 and which extends above the surface 29 of the die block. Additionally, a block 46 is provided which functions as an anvil and which supports the strip as it is moved down over the pre-shaving tool 44. The pre-shaving tool performs a shaving operation on the stock from the second rolled surface so that a smooth surface 48 extends inwardly from the second rolled surface 11 towards the first surface. The pre-shaving tool 44 is dimensioned such that it does not move entirely through the stock 10 and preferably moves no more than about half way through the stock, a distance of about 0.007 (0.178 mm) inches if the stock has a thickness of about 0.014 inches. An internal burr 64 is produced by this step.

Figure 8:
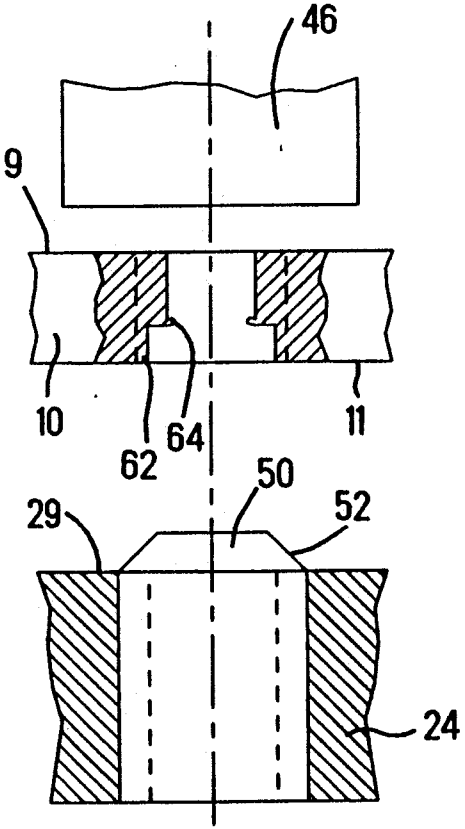

A third station, FIG. 8 is provided for coining the strip at the intersection of the surface 48 and the second rolled surface 11. The coining tool 50 extends for only a very short distance above the surface 29 of the die block and it has inclined side coining surfaces 52 which extends at an angle of about 45° from the surface 28. When the stock material is pressed against this coining tool 50, the material at the intersection of surfaces 48 and 11 is coined and thereby locally work hardened as shown at 62. The stock is pressed against the coining tool by a block 46 which functions as an anvil.

In the final operation, the opening is shaved by a final shaving tool 56 which moves through the opening and into a die opening 58 in the block 24. The dimensions of the final shaving tool 56 are such that it removes only a very thin shaving from the edge and brings the location of the edge into conformity with the final dimensions of the contact device. When the shaving tool reaches the coined portion 62 adjacent to the second rolled surface 11, an abrupt fracture takes place because of the fact that the material was previously locally work hardened by the coining operation. The fracture is a brittle fracture and does not produce a burr as would otherwise be produced in a conventional shaving operation and as is usually produced in a conventional punching operation.

Figure 11:
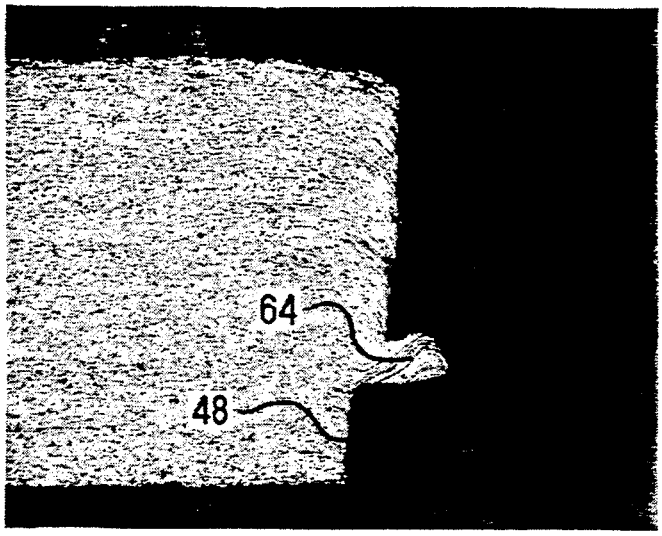
FIGS. 11-13 are photomicrographs of the edge produced by the pre-shaving, coining and shaving steps in the practice of the invention, FIG. 13 showing the finished contact edge.
Figure 12:
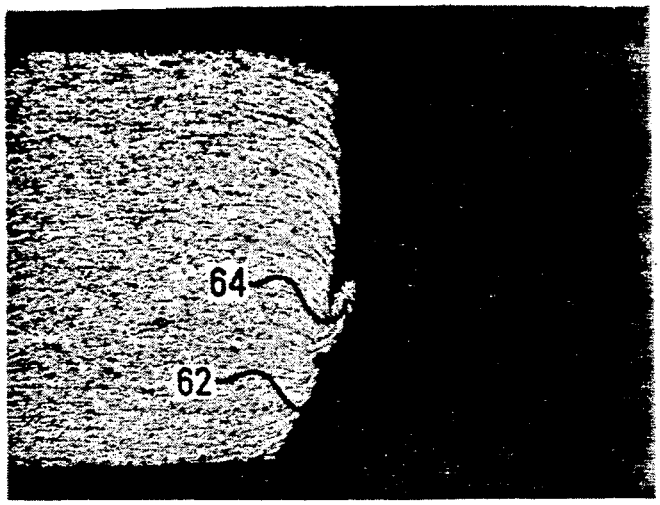

FIGS. 10–12 are photomicrographs, 150×, which show the condition of the edge produced by the operations described above. The strip material is phosphor bronze in half hard condition having a thickness of 0.014 inches (0.356 mm). The phosphor bronzes are alloys containing approximately 92–95% copper, 0.1–0.35% phosphorus with the balance, exclusive of impurities, being tin. The term "half hard" means that the material was cold rolled after heat treatment.

Figure 3:
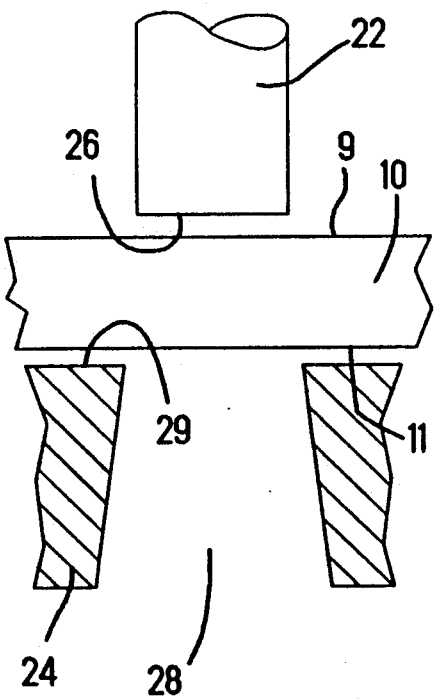
Figure 9:
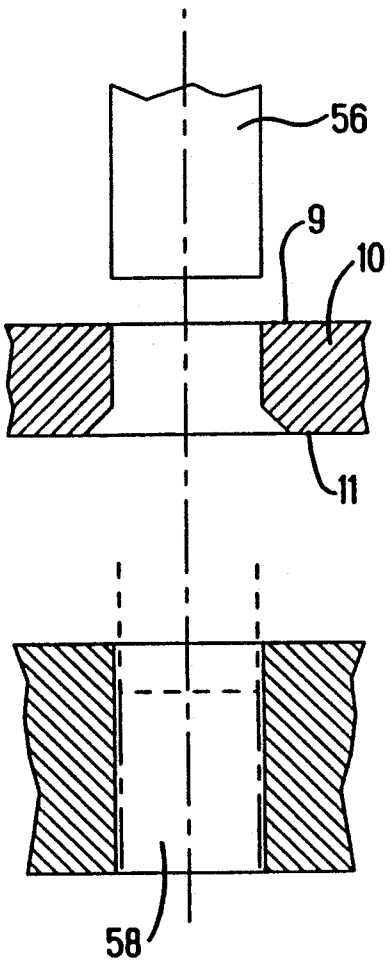
FIGS. 7-9 are views showing successive stages in the manufacturing process for producing stamped contacts having improved edges in accordance with the invention.

FIG. 10 shows the edge which is produced by the punching operation described in FIGS. 3–5. It can be seen from this photomicrograph that the metallic grains have been deformed in the downwardly direction adjacent to the edge and that the edge tapers from right to left by a slight amount as viewed from the upper major surface or upper rolled surface to the lower rolled surface. FIGS. 16 and 17 are photomicrographs at 500% of the upper and lower corner corners of the edge of a punched opening. The higher magnification shows distinctly the relative smoothness of the upper portion of the edge and the roughness of the lower portion. The specimen used for FIGS. 16 and 17 was from the same batch as the specimen used for FIG. 10 but was not necessarily the same specimen.

FIG. 11 shows the result of the pre-shaving operation. This operation has produced the burr 64 as a result of movement of the pre-shaving tool into the opening and across the edge from the lower rolled surface 11. It can also be seen that this pre-shaving operation has altered the previously deformed grain structure which was produced by the punching operation.

FIG. 12 shows the result of the coining operation and particularly the beveled surface 62 which is produced at the intersection of the rolled surface 11 and the edge. This beveled surface extends at a distinct angle for a short distance inwardly from the surface 11 and the localized deformation of the metallic grains immediately beneath the beveled surface illustrates the degree of work hardening which has taken place. The material in the vicinity of this bevel is therefore extremely hard and has a reduced capacity for plastic deformation which is to say that it will fracture readily when it is subjected to a significant stress.

FIG. 13 shows the contact edge 60 after the final shaving operation. It can be seen that this edge is straight and substantially perpendicular to the rolled surfaces 9,11. FIGS. 14 and 15 are photomicrographs at 500× of the upper corner (FIG. 14) and lower corner (FIG. 15) of the shaved edge 60. The smooth and even nature of the surface 60 is apparent in both Figures and the sharp and distinct inclination of the bevel 62 is also seen. It is apparent that the final shaving operation resulted in a clean fracture of the material when the shaving tool passed the upwardly formed burr 64 in FIG. 12. That result is a straight and smooth surface for substantially the entire thickness of the strip material and the result that the contact surface will be straight and smooth throughout its width.

The invention can be practiced with suitable tooling in a conventional stamping press having a fixed platen and a reciprocable ram with the tooling mounted in a conventional die shoe assembly. It is preferred however to use a machine of the type shown in FIG. 18 and described in U.S. Pat. No. 5,007,282. Machines of the type described in that patent have a horizontal generally rectangular housing 76 in which are contained first and second ram assemblies 70,70' which are coupled as shown at 72,72' to oscillating levers 74,74'. Oscillation of the levers results in reciprocation of the ram assemblies towards and away from each other. The strip material 10 is fed through openings in the sides of the housing 76 and between the opposed faces of the ram assemblies 70,70'. The tooling described above is mounted on the ram assemblies in the manner described by U.S. Pat. No. 5,007,282 and in other patents relating to machines of the same general type.

It is preferred to have four steps in the process for producing contact edges in accordance with the invention including the pre-shaving step illustrated in FIGS. 7 and 11. However, if the material is extremely hard, the pre-shaving step can be eliminated under some circumstances. If the pre-shaving step is eliminated, the opening produced by the punch 22 and die opening is coined by a coining die as shown in FIG. 8. The final shaving step is then carried out as described above.

The principal advantage of the invention is the achievement of a smooth contact surface 60 on flat stamped electrical contact devices. The contact surface 60 extends from one major surface of the contact device substantially to the second major surface excepting for the very narrow coined beveled portion 62. Also, the contact surfaces are burr free by virtue of the fact that the shaving is eliminated by a brittle fracture in the material when the shaving tool reaches the coined zone.

We claim:

1. A punch and die assembly for manufacturing stamped electrical contacts from strip material which has oppositely facing first and second parallel rolled surfaces, each of the contacts having a first and second edge surface which extends substantially normally of, and between, the rolled surfaces to define a hole, the first edge surface being the contact surface of the contact, the punch and die assembly comprising:

a punch and die station, a pre-shaving station, a coining station, and a final shaving station, the punch and die station comprising a punch and die for punching said hole in the strip stock, said first edge surface of the hole being the contact surface, the surfaces of said hole having a flat smooth portion and a fractured portion, the smooth portion extending inwardly from the first rolled surface to the fractured portion, the fractured portion extending from the smooth portion to the second rolled surface, the pre-shaving station performing a preliminary shaving operation by a shaving tool which is moved against the second rolled surface and partially across the fractured portion of said hole towards the first rolled surface, the coining station having a coining die which coins, and work hardens the pre-shaved and fractured portion adjacent to the second rolled surface, the final shaving station having a final shaving tool which shaves the contact surface along a final shaving path which extends from the first rolled surface to the coined portion, whereby, the final shaving tool produces a smooth shaved surface on the surface of the hole which extends from the first rolled surface to the coined portion, and the coined portion is fractured without plastic deformation and without producing a burr at the second rolled surface.

2. A punch and die assembly as set forth in claim 1 characterized in that the coining die has an inclined coining surface which moves against the intersection of the fractured portion and the second rolled surface and produces a work hardened beveled surface.

3. A punch and die assembly as set forth in claim 1 in combination with a stamping and forming machine which has first and second ram assemblies which move horizontally towards and away from each other, said ram assemblies having opposed faces for receiving said strip material therebetween, whereby the four stations of the punch and die assembly is mounted for reciprocal movement on the first and second ram assemblies, where said coining die is on the second ram assembly, and said final shaving tool is on the first ram assembly.

4. A punch and die assembly as set forth in claim 1 in combination with a stamping and forming machine which has first and second ram assemblies which move horizontally towards and away from each other, said ram assemblies having opposed faces for receiving said strip material therebetween, whereby the four stations of the punch and die assembly are mounted for reciprocal movement on the first and second ram assemblies, where said pre-shaving tool and the coining die are on the second ram assembly, and the final shaving tool is on the first ram assembly.

5. A punch and die assembly as set forth in claim 1 wherein the final shaving tool is dimensioned so as to remove only a very thin shaving on the surface of the hole which extends from the first rolled surface to the coined portion.

6. A punch and die assembly as set forth in claim 1 wherein said pre-shaving tool is dimensioned so as to produce an inwardly directed burr about the surface of said hole.

* * * * *